United States Patent [19]

Gauger

[11] Patent Number: 4,593,596

[45] Date of Patent: Jun. 10, 1986

[54] PORTABLE DRUM SET

[76] Inventor: Gary L. Gauger, 15108 Highland La., Minnetonka, Minn. 55343

[21] Appl. No.: 695,437

[22] Filed: Jan. 28, 1985

Related U.S. Application Data

[63] Continuation-in-part of Ser. No. 505,207, Jun. 17, 1983.

[51] Int. Cl.[4] ..... G10G 5/00

[52] U.S. Cl. ..... 84/421

[58] Field of Search ..... 84/411 R, 412, 419–421, 84/DIG. 3; 248/316.1, 316.2, 316.6, 316.8, 231, 166–168, 188.1, 163.1, 439

[56] References Cited

U.S. PATENT DOCUMENTS

| | | | |
|---|---|---|---|
| 3,211,381 | 10/1965 | Rasmussen | 248/231 X |
| 4,158,980 | 6/1979 | Gauger | 84/421 |
| 4,252,047 | 2/1981 | Gauger | 84/421 |
| 4,356,757 | 11/1982 | Mooy | 84/411 R |
| 4,416,181 | 11/1983 | Hartry et al. | 84/411 R X |

*Primary Examiner*—Benjamin R. Fuller

*Attorney, Agent, or Firm*—Williamson, Bains, Moore & Hansen

[57] ABSTRACT

A portable drum set is provided by utilizing a pre-tuned head which is clamped to an arcuate member. The arcuate member has a pair of floor-engaging legs on either side which are releasably clamped to the arcuate member. Other percussion instruments such as drums or cymbals may be mounted to the top of the arcuate member or the legs to provide a full kit. Also, a resilient pad is placed on the bottom surface of the bass drum pedal to help isolate the set and vibrations from the supporting surface. The clamps may be formed either of a resilient material such as rubber or may be formed of metal to rigidly clamp the pre-tuned head rim to the arcuate member.

8 Claims, 5 Drawing Figures

PORTABLE DRUM SET

CROSS REFERENCE TO RELATED APPLICATION

This application is a continuation-in-part of my application Ser. No. 505,207, filed June 17, 1983.

BACKGROUND OF THE INVENTION

For many years the drum industry has been relatively stagnant in producing innovation changes from traditional drum sets and kits. One relatively recent innovation is the so-called pre-tuned head which is shown in U.S. Pat. Nos. 4,356,757 and 4,416,181. While these patents show a pre-tuned head, there has been to date not a full apppreciation of the potential of that invention. In particular, the above referenced patents are utilized in effect with conventional drums having regular shells and some sort of clamp which holds the head to the shell. My earlier filed application Ser. No. 505,207, filed June 17, 1983, the contents of which are incorporated herein by reference, shows how pre-tuned heads may be utilized without a shell to produce an effective sounding, highly protable drum without the bulky shell. Also, various methods of mounting drums are shown in my prior U.S. Pat. Nos. 4,158,980 and 4,252,047 and the patents cited therein.

It is therefore an object of this invention to provide a drum set which will utilize the pre-tuned heads and yet which has sound characteristics approaching if not equaling conventional drum sets. It is further an object of this invention to produce a portable drum set which may be easily carried and set up and which utilizes a minimum amount of space both in storage and in use.

SUMMARY OF THE INVENTION

A portable drum set is provided which utilizes pre-tuned heads and which has no shells as such. In particular, an arcuate member which extends more than 180° and is slightly larger in diameter than the bass drum pre-tuned head is placed around the pre-tuned head and clamped thereto, either with a two piece metal clamp or with a molded block of resilient material such as rubber, which has slots which engage both the arcuate member and the rim of the pre-tuned head. Ideally, one such clamp (either rubber or metallic) is provided adjacent each end of the arcuate member and a plurality of further clamps are provided intermediate the ends. In practice, the preferred number of such clamping points is six total (including the end clamps) although fewer clamps may be utilized.

Located diametrically opposite on the arcuate member (which is oriented vertically with the open end of the arc facing downward) are two leg assemblies, each leg assembly having a gripping member which grips a pair of legs vertically therein and which may be releasably utilized to clamp the legs. The legs may then be adjusted both vertically and rotationally to provide the most stable base and also to allow folding such that the angle portion of the leg fits in adjacent the circumference of the head to provide a highly compact unit for storage.

One or more drums, cymbals or other percussion instruments may be attached to a plate which is fastened to the arcuate member adjacent the top thereof. Such additional instruments are generally desirable for a percussionist and indeed are particularly desirable in this instance as the extra weight of such instruments helps stabilize and prevent movement of the set. Additional percussion instruments may also be positioned by using a sleeve which fits over one of the legs and which is clamped thereto.

The legs are adjusted so that the bottom of the pre-tuned head is clear of the floor or supporting surface upon which the set is placed. Bass drum pedals typically have a die cast bottom surface which is generally placed directly on the floor or supporting surface. In the instant invention, a pad of resilient material is placed on the bottom surface of the pedal thereby helping to isolate the pedal (which is in turn clamped to the bottom of the bass drum head rim), thereby isolating the bass drum from the supporting surface and allowing a purer sound to result.

These and other objects and advantages of the invention will appear more fully from the following description made in conjunction with the accompanying drawings wherein like reference characters refer to the same or similar parts throughout the several views.

DESCRIPTION OF THE PREFERRED EMBODIMENT

Figure 1:
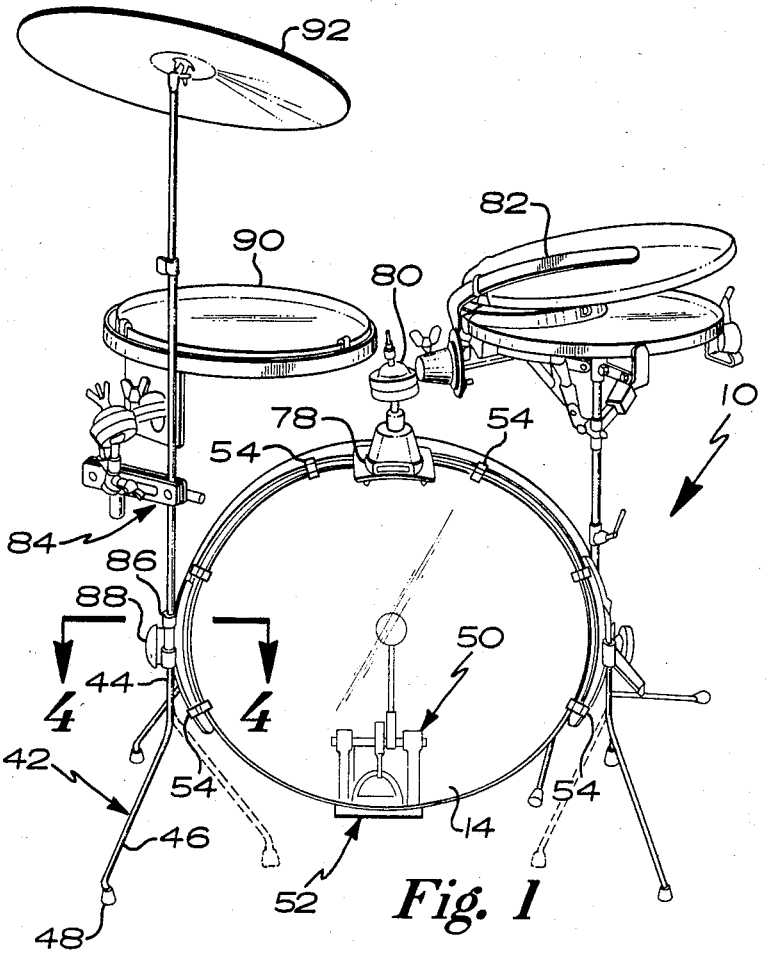
FIG. 1 is a front perspective view showing a set utilizing the instant invention.

The instant invention, generally designated 10, is shown in general in FIG. 1. Set 10 is designed for use with a pre-tuned head assembly 12 such as that described in U.S. Pat. Nos. 4,356,756 and 4,416,181. Such pre-tuned head assemblies 12 are comprised generally of a film 14 and a rim 16.

Figure 4:
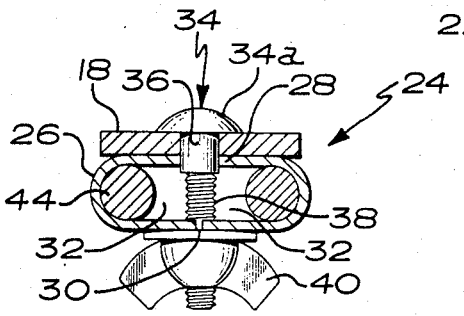
FIG. 4 is a sectional view of the leg assembly taken along line 4—4 of FIG. 1.
Figure 2:
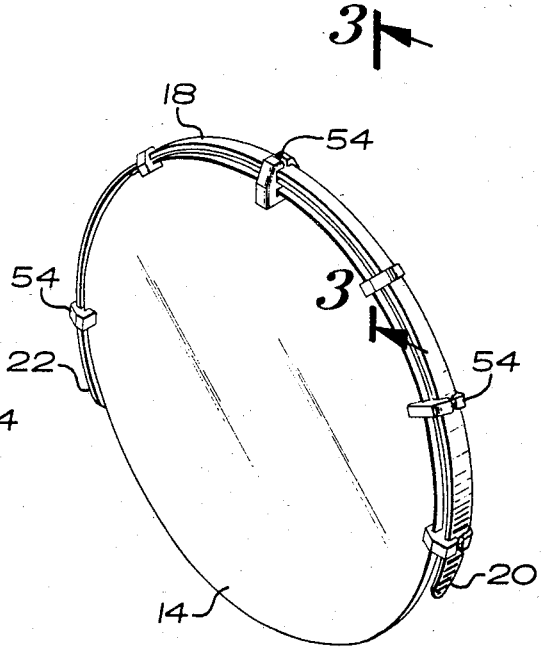
FIG. 2 is a simplified perspective view showing the resilient member clamp holding the arcuate member to the pre-tuned head.

In practice, an arcuate member 18 is utilized which extends somewhat more than 180° around the head assembly 12. Arcuate member 18 is provided with first and second ends 20 and 22, respectively. Gripping assembly 24 is shown in detail in FIG. 4. One such gripping assembly 24 is located on either side of arcuate member 18 at diametrically opposite points. In particular, gripping assembly 24 is comprised of a generally ovoid metal band having a hole 28 in one side thereof and a cut or split 30 in the other side. Two pockets 32 are formed for the leg members in gripping assembly 24. A carriage bolt 34 may be utilized to provide adjustment wherein carriage bolt 34 has a square head **34*a*, a square portion 36 and a threaded portion 38. A wing nut 40 may be utilized to secure the gripping member. Legs 42 pass through pockets 32 and may be slid vertically as well as rotated therein to provide the proper adjustment. Normally the legs will be positioned as shown in FIG. 1 in solid and may be folded to the position shown in phantom for storage and/or transport. Legs 42 are comprised of a vertical portion 44 which fits in pockets 32, an angled portion 46 and feet 48**.

A standard foot pedal assembly 50 is clamped to rim 16 of head assembly 12 via conventional hardware. The normally bare metal bottom surface of pedal assembly 50, however, has a resilient pad 52 added thereto. The pad 52 may be made out of materials such as rubber padding to provide isolation of the pedal assembly and the head assembly 12 from the supporting surface on which the set 10 is placed. Resilient pad 52 also serves to grip and prevent movement of set 10.

Figure 3:
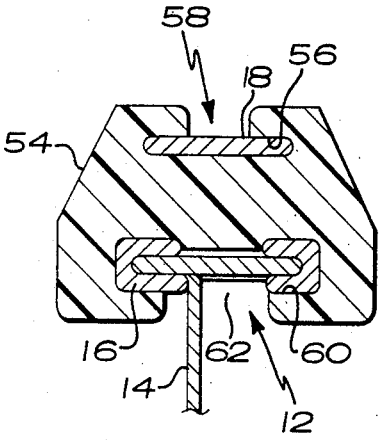
FIG. 3 is a sectional view taken along line 3—3 of FIG. 2.

Shown in detail in FIG. 3, a clamping lock 54 is formed of a resilient material such as rubber and is utilized to fasten the head assembly 12 to the arcuate member 18. A slot 56 is used to grippingly engage arcuate member 18, and an insertion slot 58 is provided for inserting arcuate member 18 into slot 56. Similarly, a slot 60 is provided for rim 16 of head assembly 12 and an insertion slot 62 allows the insertion of rim 16 into slot 60.

Figure 5:
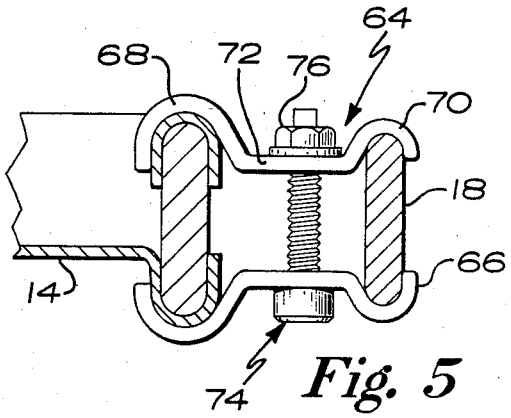
FIG. 5 is a sectional view taken along a similar section as that of FIG. 3 showing an alternate embodiment of the clamping assembly.

A rigid clamp assembly 64 is shown in detail in FIG. 5. Clamp assembly 64 is formed of two generally identical clamp pieces 66 having a rim engaging hook 68 and an arcuate member engaging hook 70 which are in turn separated by a bolt flange 72. A bolt 74 and nut 76 are used to secure the two pieces 66 together.

The embodiments shown in both FIGS. 3 and 5 have the advantage of allowing varying of spacing to produce varying tonal qualities of the drum as well as not requiring welding or other permanent fastening of the clamping assemblies.

As shown in FIG. 1, a mounting plate 78 is attached by fasteners or welding or other conventional fastening means to the top of arcuate member 18. Thence, conventional drum mounting hardware 80 is used to attach one or more other drums or other percussion instruments 82 to form a complete set. Such additional percussion instruments (drums, cymbals or the like) are in fact desirable as due to the generally light weight of the above referenced assembly, the additional weight of the instruments help to stabilize the set during enthusiastic playing. An auxilliary assembly 84 may also be utilized to add additional instruments. In particular, a sleeve 86 slips over the vertical portion 44 of leg 42 and is secured thereto with a wing nut 88. As seen in FIG. 1, an extra drum 90 and cymbal 92 may be placed thereon.

While the preferred embodiments of the present invention have been described, it should be understood that various changes, adaptions and modifications may be made therein without departing from the spirit of the invention and the scope of the appended claims.

What is claimed is:

1. A lightweight, compact, portable drum set for use on a supporting surface comprising:

a pre-tuned bass drum head having a diameter and a rim;

an arcuate member having first and second ends and a diameter, said member diameter being slightly larger than said bass head diameter and extending around greater than half said circumference of said bass head;

a plurality of clamps for retaining said bass head to said member, one of said clamps being located adjacent each said end and at least two of said clamps being located between said clamps which are adjacent said ends;

first and second leg means attached to said arcuate member approximately diametrically opposite one another and retaining said bass head and said member in a substantially vertical plane relative to the supporting surface, said bass head and member being free of contact with the surface.

2. The portable drum set of claim 1 wherein each said clamp comprises a molded piece of resilient material, said material including:

a first slot wrapping about and tightly resiliently retaining said rim; and a second slot wrapping about and tightly resiliently retaining said member.

3. The portable drum set of claim 1 including a mounting bracket attached to and carried by said member and further including at least one percussion instrument mounted on said bracket above said member to add weight and stability to the set.

4. The portable drum set of claim 1 and further comprising a base drum pedal having a bottom surface, said bottom surface having resilient material thereon, said pedal being clamped to said rim and positioned with said bottom surface frictuionally engaging the supporting surface so as to acoustically isolate said drum head and to retain the drum set in position on the supporting surface when an operator exerts downward pressure on said pedal.

5. A lightweight, compact portable drum set for use on a supporting surface comprising:

a pre-tuned bass drum head having a diameter, a circumference and a rim;

an arcuate member having first and second ends and a diameter, said member diameter being slightly larger than said bass head diameter and extending around greater than half the said circumference of said bass head;

a plurality of clamps for retaining said bass head to said member, one of said clamps being located adjacent each of said ends and at least two of said clamps being located between said clamps which are adjacent said ends;

first and second leg means attached to said arcuate member approximately diametrically opposite one another and retaining said bass head and member in a substantially vertical plane relative to the supporting surface, said bass head and member being free of contact with the surface;

each said clamp including:

first and second relatively rigid pieces, each said piece comprising a first recess receiving said rim and a second recess receiving said member; and means for tensioning said pieces to each other to retain said rim and said member between said pieces with said first recesses facing one another and said second recesses facing one another; and said tensioning means including a flange on each said piece intermediate said first and second recess and bolt means adjustably connecting said flanges.

6. A lightweight, compact, portable drum set for use on a supporting floor surface comprising:

a pre-tuned, lightweight, shell-less base drum head having a circumference, a diameter, a rim and a center of gravity located substantially within the plane of said rim;

an arcuate member lying substantially within a common plane and having first and second ends and a diameter, said arcuate member diameter being slightly larger than said base head diameter and extending around more than half said circumference of said bass head with said center of gravity of said head being within the common plane of said member;

a plurality of clamps for retaining said bass drum head to said arcuate member, one of said clamps being located adjacent said first end and one adjacent said second end, and at least two of said clamps being located between the said clamps which are adjacent said ends; and first and second leg means attached to said arcuate member approximately diametrically opposite one another and retaining said bass head and said arcuate member in a substantially vertical plane relative to said floor surface, said bass head and member being free of contact with the floor surface.

7. The portable drum set of claim 6 wherein each said clamp comprises a molded piece of resilient material, said material including:

a first slot wrapping about and tightly, resiliently retaining said rim;

a second slot wrapping about and tightly, resiliently retaining said arcuate member; and each said clamp being substantially within a common plane passing through said center of gravity of said head and reducing unwanted damping of said head by acoustically isolating said head from said member.

8. The lightweight, compact portable drum set of claim 6 wherein each said leg means comprises a pair of leg members; and said set further includes first and second brackets fixed to said member adjacent the ends thereof with each said bracket releasably, rotatably engaging a said pair of leg members for rotation between a rest position underlying the head and a support position extending outwardly and away from said head; and a bass drum pedal fixed to said head and having a bottom surface carrying a resilient material thereon with said material closely, frictionally engaging the supporting surface so that when an operator puts foot pressure on said pedal to beat said head, the foot pressure as applied through said resilient material of said pedal firmly anchors said lightweight drum set to the supporting surface and prevents unwanted lateral shifting relative to the supporting surface.

* * * * *